US011525295B2

(12) United States Patent
Nordieker et al.

(10) Patent No.: US 11,525,295 B2
(45) Date of Patent: Dec. 13, 2022

(54) FURNITURE BOARD HAVING A FLAP FITTING AND CARCASS AND FURNITURE ITEM HAVING SUCH A FURNITURE BOARD

(71) Applicant: HETTICH-ONI GMBH & CO. KG, Vlotho (DE)

(72) Inventors: Martin Nordieker, Hüllhorst (DE); Jens Poischbeg, Leopoldshöhe (DE); Michael Tasche, Bielefeld (DE); Karsten Nolte, Lemgo (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 567 days.

(21) Appl. No.: 16/605,938

(22) PCT Filed: Apr. 11, 2018

(86) PCT No.: PCT/EP2018/059268
§ 371 (c)(1),
(2) Date: Oct. 17, 2019

(87) PCT Pub. No.: WO2018/192819
PCT Pub. Date: Oct. 25, 2018

(65) Prior Publication Data

US 2021/0010311 A1 Jan. 14, 2021

(30) Foreign Application Priority Data

Apr. 18, 2017 (DE) ..... 10 2017 108 197.6
Nov. 10, 2017 (DE) ..... 10 2017 126 368.3

(51) Int. Cl.
*E05F 1/08* (2006.01)
*E05F 3/20* (2006.01)
(Continued)

(52) U.S. Cl.
CPC ..... *E05F 3/20* (2013.01); *E05F 3/18* (2013.01); *E05F 3/22* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 4,383,347 A * 5/1983 La Conte ..... E05F 1/1292 16/370
9,719,283 B2 * 8/2017 Holzapfel ..... A47B 96/00
(Continued)

FOREIGN PATENT DOCUMENTS

CN 105155962 A 12/2015
CN 105587196 A 5/2016
(Continued)

OTHER PUBLICATIONS

International Search Report dated Jun. 19, 2018 in related/corresponding International Application No. PCT/EP2018/059268.
(Continued)

*Primary Examiner* — Chuck Y Mah
(74) *Attorney, Agent, or Firm* — Patent Portfolio Builders PLLC

(57) ABSTRACT

A furniture board with an integrated or inserted flap fitting includes a lever mechanism having a plurality of levers guiding a flap of a furniture item. The flap fitting has a spring unit acting on at least one lever of the lever mechanism via an adjustable preload. The lever mechanism, in a closed position of the guided flap, moves into a front-side opening of the flap fitting and a front-side opening of the furniture board. The preload of the spring unit and/or the transmission ratio between the spring unit and the lever mechanism is
(Continued)

Figure 1A:
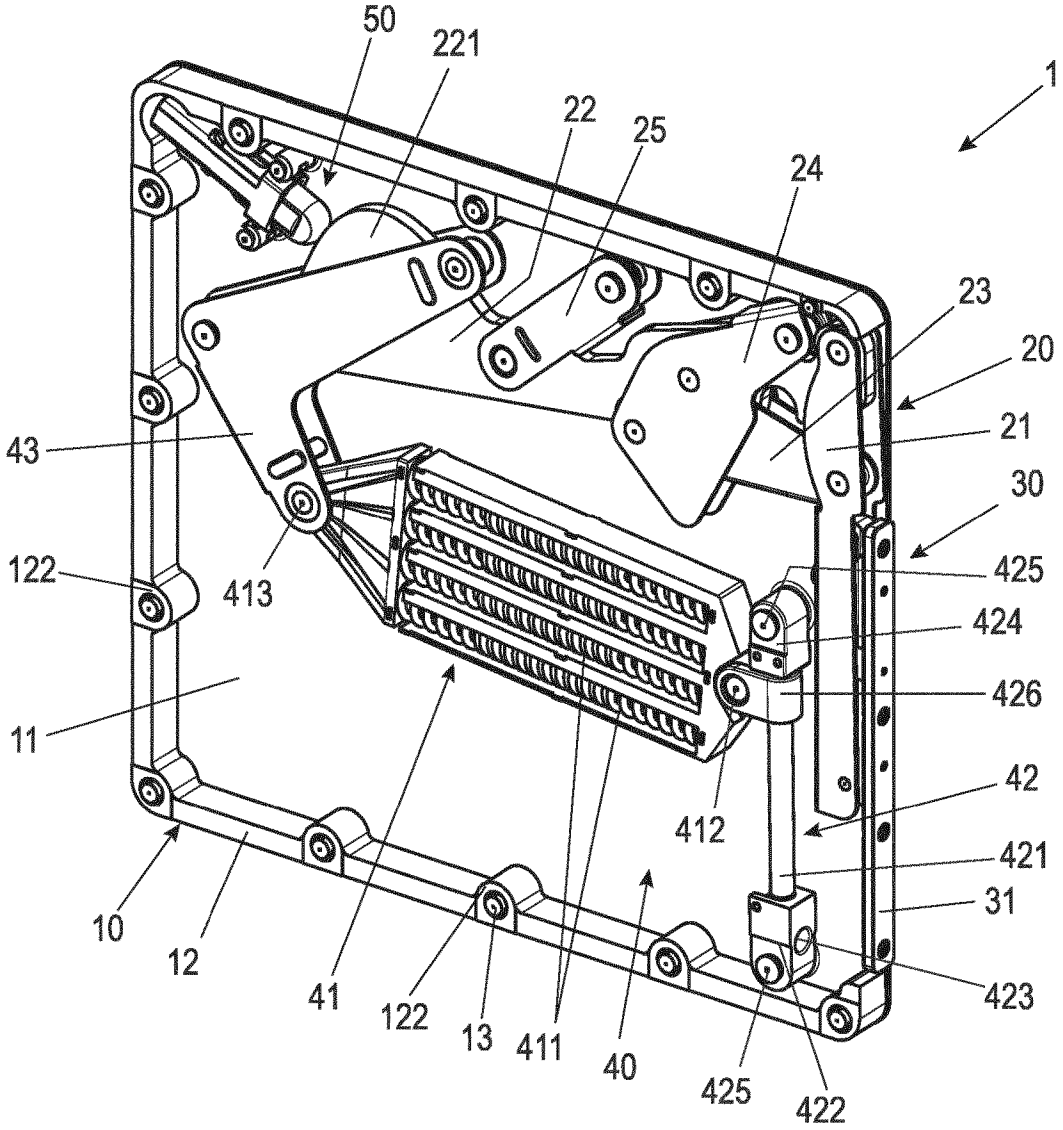

adjustable via an adjusting element having a tool receptacle. The tool receptacle is accessible through a front-side opening in the furniture board and/or the flap fitting.

17 Claims, 15 Drawing Sheets

(51) Int. Cl.
*E05F 3/18* (2006.01)
*E05F 3/22* (2006.01)

(52) U.S. Cl.
CPC ..... *E05Y 2201/492* (2013.01); *E05Y 2600/41* (2013.01); *E05Y 2900/20* (2013.01)

(58) Field of Classification Search
CPC ..... E05F 5/02; E05F 3/18; E05F 3/22; E05F 3/20; E05F 11/54; E05D 3/16; E05D 11/00; E05D 15/40; E05D 2003/163; E05D 3/06; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS 10,588,407 B2 * 3/2020 Held ..... E05F 1/1292 16/370
2001/0039762 A1 * 11/2001 Giovannetti ..... E05F 1/1091 49/246
2004/0239213 A1 * 12/2004 Hirtsiefer ..... E05F 1/1058 312/109
2007/0124893 A1 * 6/2007 Brustle ..... E05F 5/02 16/296
2008/0048538 A1 * 2/2008 Karg ..... E05F 1/1066 312/319.2
2011/0138960 A1 * 6/2011 Omann ..... E05C 19/165 74/490.07
2012/0161598 A1 * 6/2012 Blum ..... E05C 19/165 74/490.07
2013/0333291 A1 * 12/2013 Blum ..... E06B 3/385 49/386
2015/0351539 A1 * 12/2015 Baldreich ..... E06B 3/34 312/319.2
2015/0361705 A1 * 12/2015 Folie ..... A47B 96/00 74/99 R
2017/0204645 A1 7/2017 Lubetz et al.
2017/0292307 A1 * 10/2017 Hirtsiefer ..... E05D 11/00
2018/0291665 A1 * 10/2018 Güzeltepe ..... E05C 19/165 74/490.07
2018/0363348 A1 * 12/2018 Schluge ..... E05F 1/1066 312/319.2
2019/0242167 A1 * 8/2019 Salice ..... E05F 5/02 16/296
2019/0316394 A1 * 10/2019 Kruedener ..... E05F 1/1058 312/109
2021/0148149 A1 * 5/2021 Pleuteri ..... E05F 1/1091 49/246
2021/0172229 A1 * 6/2021 Oshima ..... E05F 1/1091 49/246

FOREIGN PATENT DOCUMENTS

DE 1559963 A1 12/1969
DE 102006007702 A1 8/2007
DE 202010015091 U1 2/2012
DE 202017101255 U1 3/2018
EP 0952290 A2 10/1999
EP 2570575 A1 3/2013
WO 2016077851 A1 5/2016
WO 2016174071 A1 11/2016

OTHER PUBLICATIONS

Search Report dated Jul. 25, 2018 in related/corresponding DE Application No. 10 2017 126 368.3.
Search Report dated Mar. 21, 2018 in related/corresponding DE Application No. 10 2017 108 197.6.
Written Opinion dated Jun. 19, 2018 in related/corresponding International Application No. PCT/EP2018/059268.

* cited by examiner

FURNITURE BOARD HAVING A FLAP FITTING AND CARCASS AND FURNITURE ITEM HAVING SUCH A FURNITURE BOARD

BACKGROUND AND SUMMARY OF THE INVENTION

Exemplary embodiments of the invention relate to a furniture panel having an integrated or inserted flap fitting, which comprises a lever mechanism having multiple levers for guiding a flap of an item of furniture. The flap fitting comprises a spring unit, which acts on at least one lever of the lever mechanism, wherein a pre-tension of the spring unit is settable. Exemplary embodiments of the invention furthermore relate to a furniture body or an item of furniture having at least one flap fitting.

Furniture, in particular kitchen furniture or living room furniture such as base units or hanging cabinets, generally has a furniture body open toward the front, on which movable furniture parts guided via fittings are installed. In particular, in the case of hanging cabinets, flaps are frequently used as movable furniture parts for closing the furniture body, which are mounted via at least one, generally two, laterally arranged flap fittings. The flap fittings enable opening upward (pivoting up) of the flap, wherein the flap may be pivotable, for example, around a horizontally extending imaginary pivot axis arranged in the upper region of the furniture body. Other upwardly oriented opening movements of a flap are also conceivable.

The lever mechanism of the flap fitting is typically formed in multiple parts as a multi-joint lever mechanism, so that a so-called door bearing lever, on which the flap is fastened, executes a combined pivoting and sliding movement or a pivoting movement which takes place around a pivot axis located outside the flap fitting and generally also outside the furniture body.

A flap fitting having a lever mechanism and a spring acting on one of the levers is known from the document CN 105 155 962 A. The spring holds the guided flap with application of force both in the closed state and also in the completely open state. The force to be applied by the spring, in this case to the lever mechanism, in particular in the open state, is strongly dependent on the geometry and the weight of the guided flap. To ensure that flaps of different sizes and weights are held reliably in the open position, the spring pre-tension of the spring is settable. For this purpose, a bearing point of the spring is adjustable via a spindle in relation to a housing of the flap fitting. The spindle is connected via a deflection gearing to a laterally accessible tool receptacle. During installation of the flap fitting on a side wall of a furniture body, with the flap open, the pre-tension of the spring can be set in the interior of the furniture body with the aid of a screwdriver as a tool.

The described flap fitting is suitable for installation on an inner side of a side wall of the furniture body. However, the fitting unavoidably protrudes into the interior of the furniture body in this case, which reduces the usable storage space inside the furniture body and also impairs a structuring of the interior of the furniture body. Cleaning of the interior, in particular the inner side of the side wall of the furniture body, is also obstructed by the installed fitting. Not least, a side wall on which no fittings are installed is desirable for visual reasons.

To install door hinges, milling a pocket into an end face of a side wall, into which the door hinge is insertable from the front, is known. A side wall having an integrated door hinge is provided in this manner, in which the inner side of the side wall remains free. A hinge suitable for use in such a milled pocket is known, for example, from the document DE 1 559 963.

A furniture wall having an insertable or integrated fitting is also desirable for furniture having flaps because of the mentioned advantages. The above-described flap fitting known from the document CN 105 155 962 A is not suitable for integration or insertion into a furniture wall, however, since the setting of the spring pre-tension takes place from the side, which is not possible in the case of a side wall having a continuous inner surface.

Therefore, exemplary embodiments of the present invention are directed to a furniture panel for an item of furniture having an inserted or integrated flap fitting, in which the lateral faces can be made continuous and nonetheless simple setting capability of a pre-tension of the spring unit of the flap fitting is possible. Furthermore, exemplary embodiments are directed to a furniture body and an item of furniture having at least one flap fitting and the listed advantages.

A furniture panel according to the invention is distinguished in that the lever mechanism, in a closed position of the guided flap, retracts into an end-face opening of the flap fitting and the furniture panel, wherein the pre-tension is settable via an adjustment element having a tool receptacle and wherein the tool receptacle is accessible through the end-face opening, into which the lever mechanism retracts.

The end-face opening is provided in the flap fitting and the furniture panel to accommodate the lever mechanism in the closed state of the flap. According to the invention, this opening is also used to set the pre-tension of the spring unit of the flap fitting and/or a transmission ratio between the spring unit and the lever mechanism. The tool receptacle is arranged and aligned for this purpose in the flap fitting in such a way that it is accessible through the mentioned opening, whereby a setting capability is provided without an additional, for example, lateral setting opening having to be provided. A continuously homogeneous appearance of the lateral faces of the furniture construction panel is thus maintained.

In one advantageous embodiment of the furniture panel, the flap fitting comprises a spindle unit having a spindle, using which a spring bearing is movable, wherein the spindle is coupled to the adjustment element. The spindle is preferably coupled via an angular gear to the adjustment element. A simply and compactly implementable adjustment option for the spring pre-tension is provided by a movement of the spring bearing. Due to the angular gear, a setting can take place through the end-face opening of the furniture construction panel, even if the spindle extends parallel or diagonally in relation to the alignment of the end face.

The spindle can be dimensioned in this case so that it can directly absorb forces transmitted from the spring bearing. Alternatively, it is also possible to mount the spring bearing so it is linearly displaceable in a guide rail arranged parallel to the spindle, so that forces can be absorbed entirely or partially by the guide rail. The spindle can accordingly be dimensioned thinner. The guide rail can be formed U-shaped, for example.

In a further advantageous embodiment of the furniture panel, the spring unit acts via a pressure roller on a control portion of one of the levers of the lever mechanism, whereby the flap fitting is held in the closed and/or an open end position. It can be precisely specified in this case via the shaping of the control portion how strongly and in which direction the spring force acts on the lever mechanism as a function of the opening angle of the flap fitting.

In a further advantageous embodiment of the furniture panel, the flap fitting comprises a housing, which comprises two parallel sides spaced apart from one another, for example, formed by side panels. Preferably, all joint axes of the lever mechanism are positioned between the sides in a closed state of the flap fitting. Thus, a furniture panel is provided that does not impair the appearance of the furniture body due to protruding components of the flap fitting. Furthermore, the sides preferably have an internal spacing that is less than 16 mm (millimeters) and is preferably less than 14 mm. In spite of integrated flap fitting, furniture walls thus have the conventional wall thickness of furniture bodies, which is important for the visual impression of the item of furniture and also ensures the unrestricted use of machine tools used up to this point.

In a further advantageous embodiment of the furniture panel, the sides of the flap fitting extend up to the end-face opening of the furniture panel, which is advantageous, inter alia, for reasons of the strength of the furniture panel in the region of the opening. The sides can moreover be used to support components of the flap fitting, for example, the spindle unit is preferably fastened on at least one of the sides.

In a further advantageous embodiment of the furniture panel, the flap fitting is inserted through the opening of the furniture panel into a pocket formed behind the opening in the furniture panel. Alternatively, the flap fitting can be integrated into this pocket during the production of the side wall. Furthermore, the flap fitting can alternatively be inserted laterally through a pocket, which is introduced from a lateral face of the furniture panel and which comprises an opening on the end face. In all mentioned cases, the mentioned opening, through which the lever mechanism of the flap fitting extends, is preferably formed in a front end face of the furniture panel.

In a further advantageous embodiment, the furniture panel has no or almost no thickness difference in the region of the flap fitting and outside this region.

In a further advantageous embodiment of the furniture panel, the tool receptacle is accessible through the end-face opening of the furniture panel, whereby a setting capability is provided without an additional opening being provided.

Alternatively, the tool receptacle can be settable through a different end-face opening of the furniture panel than the above-mentioned end-face opening of the furniture panel, into which the lever mechanism retracts. This is slightly more complex but also enables setting without the lateral faces of the furniture body being impaired.

In a further advantageous embodiment of the furniture panel, a scale, which is visible to a user, is arranged on the adjustment element. Such a scale enables presetting of the spring pre-tension, for example, of the spindle unit to specific predetermined values. Moreover, the scale facilitates an identical setting of multiple flap fittings which jointly guide a flap.

A side wall according to the invention for a furniture body is distinguished by the use of at least one such furniture panel having inserted or integrated flap fitting. An item of furniture according to the invention having a furniture body and a guided flap is distinguished by such a furniture body having at least one such side wall having inserted or integrated flap fitting. The advantages mentioned in conjunction with the flap fitting result. In particular, an item of furniture having a guided flap can be provided, the interior of which can be used in its entire size, which can be designed freely and which has a visually appealing effect.

BRIEF DESCRIPTION OF THE DRAWING FIGURES

Figure 1B:
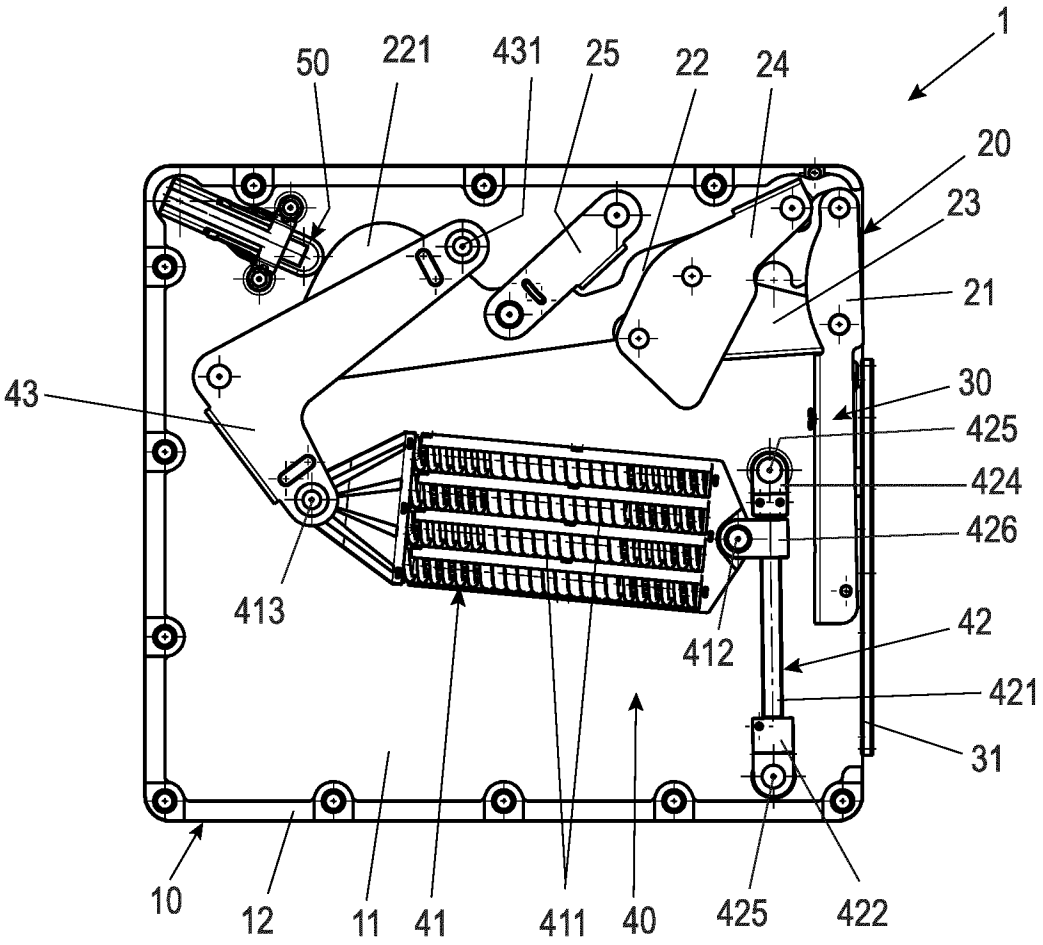
Figure 2A:
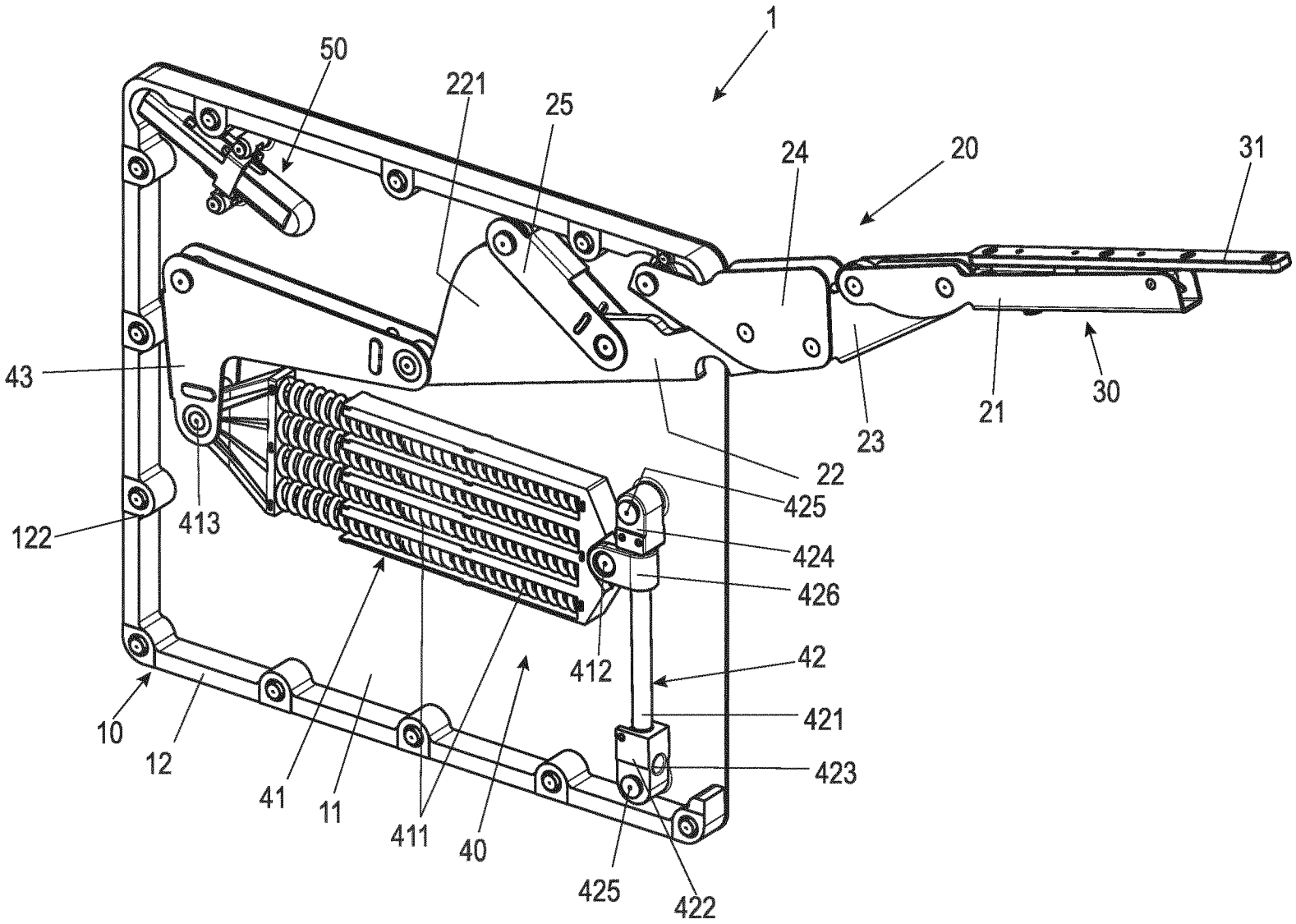
Figure 2B:
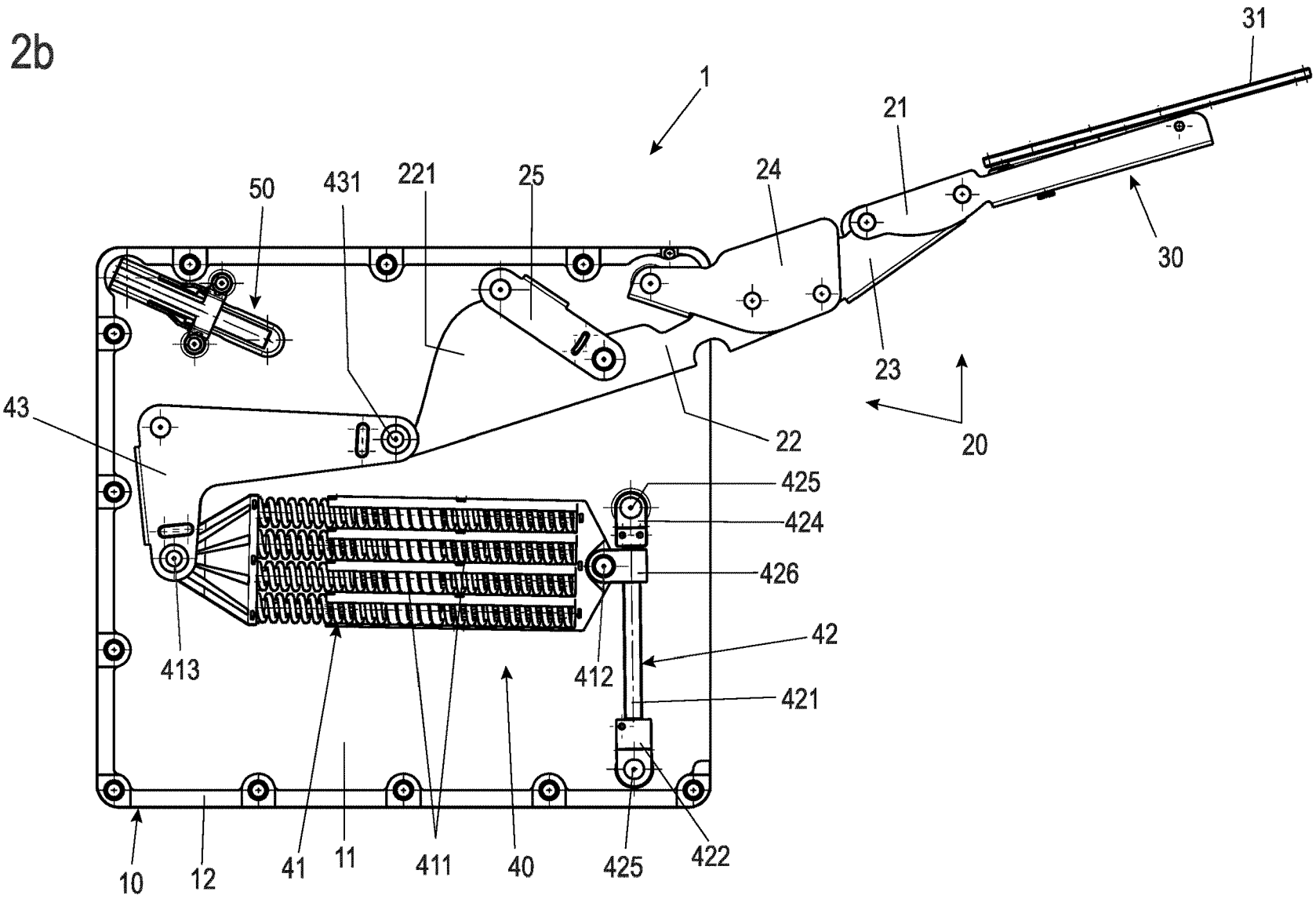
Figure 3A:
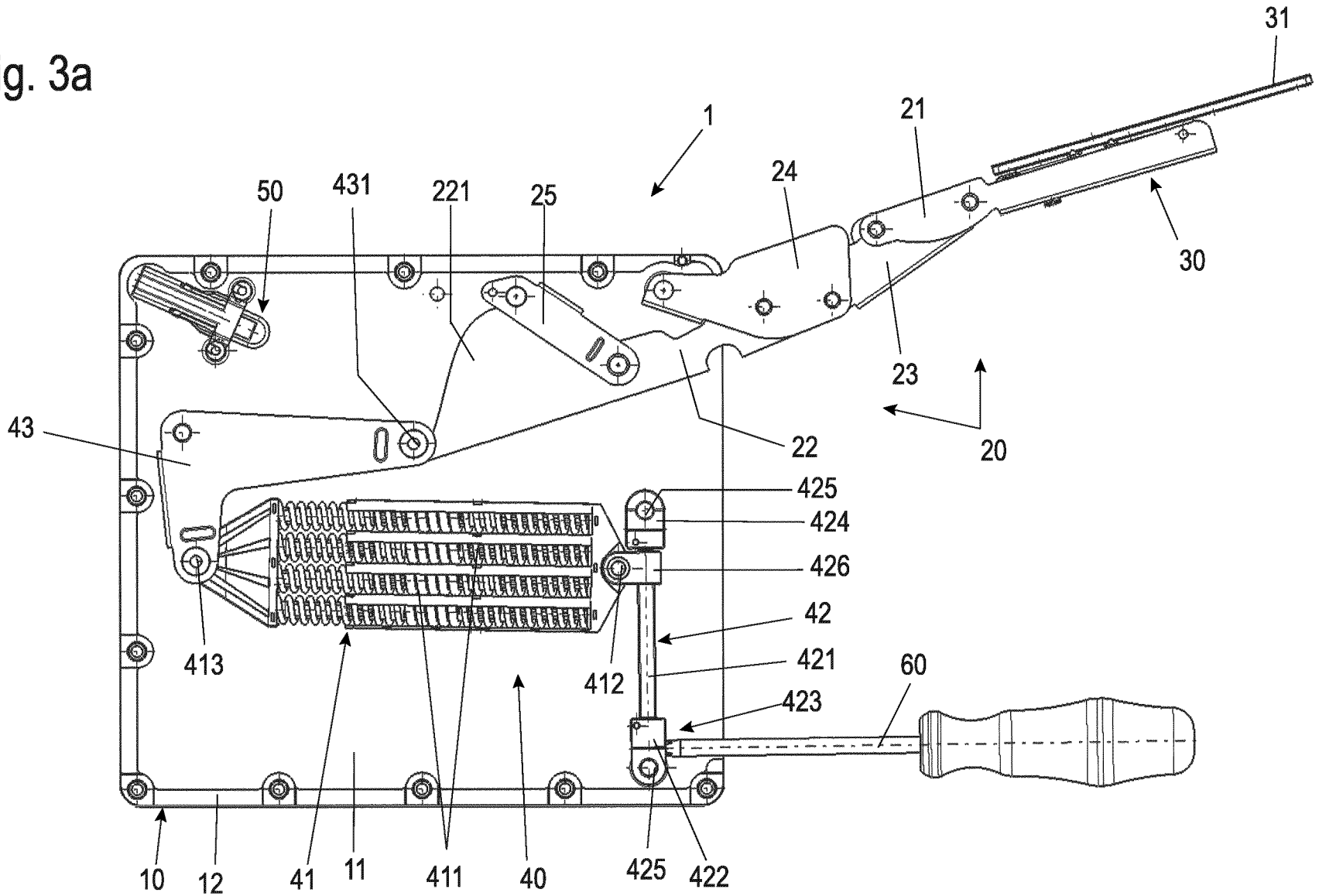
Figure 3B:
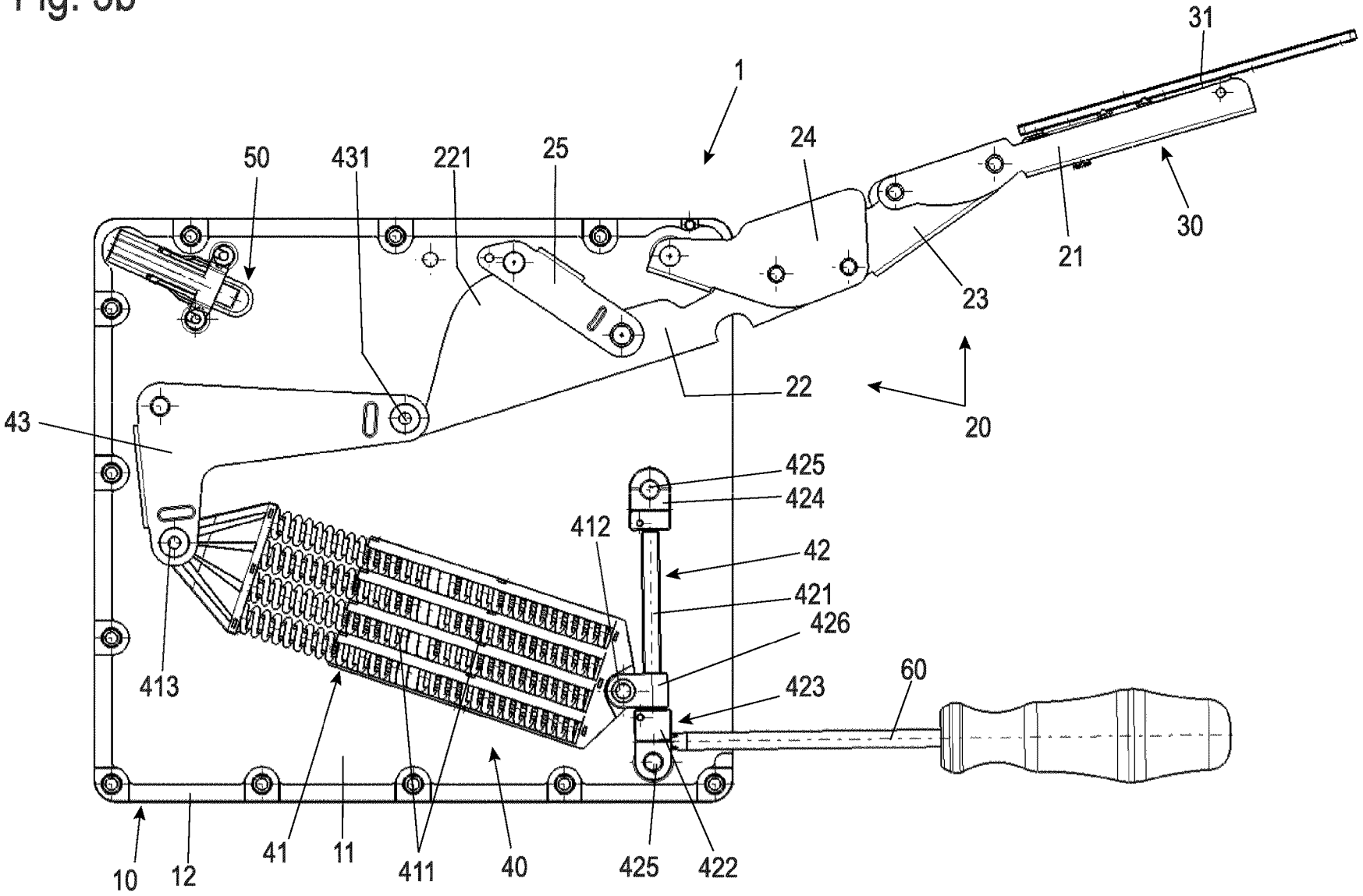
Figure 4A:
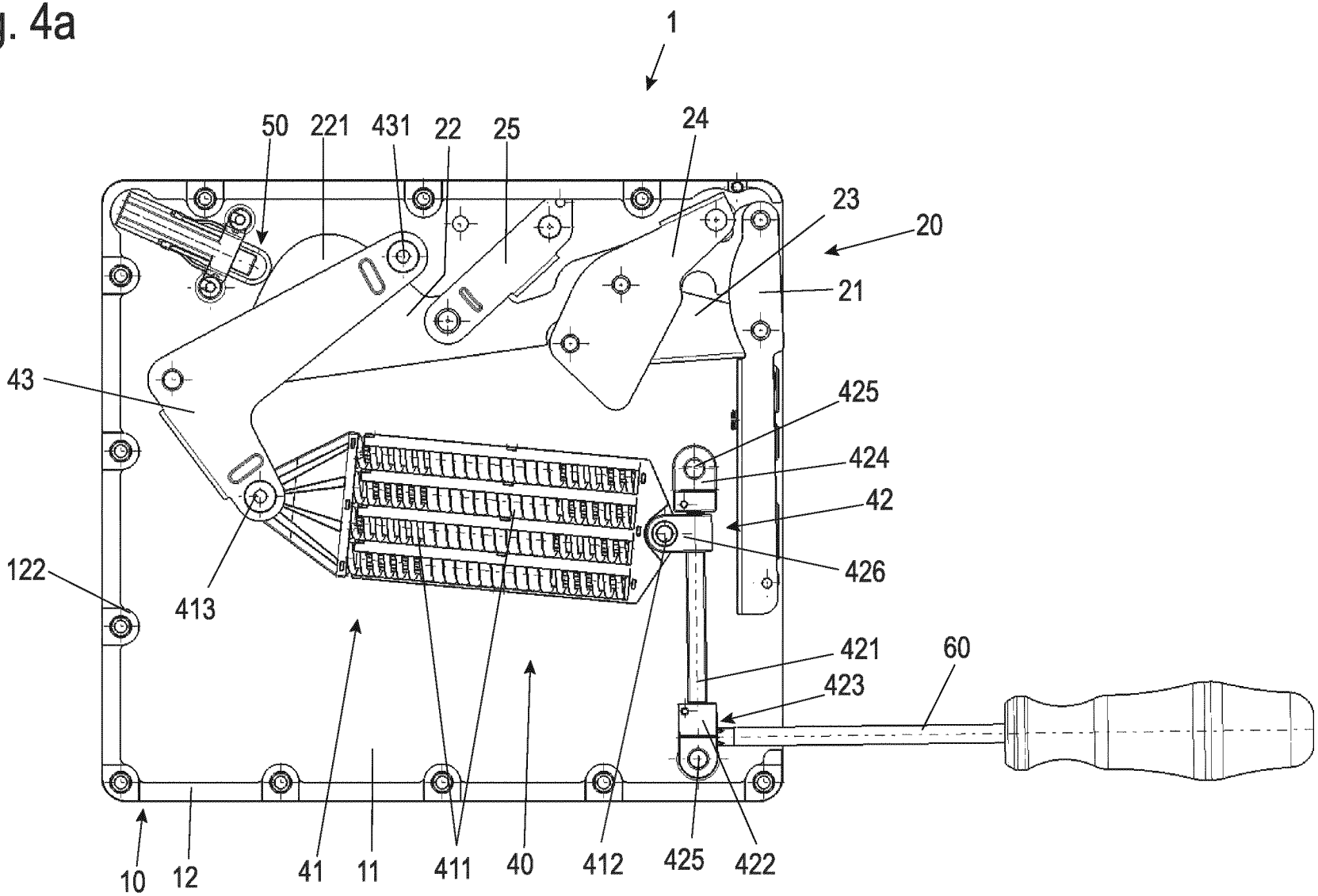
Figure 4B:
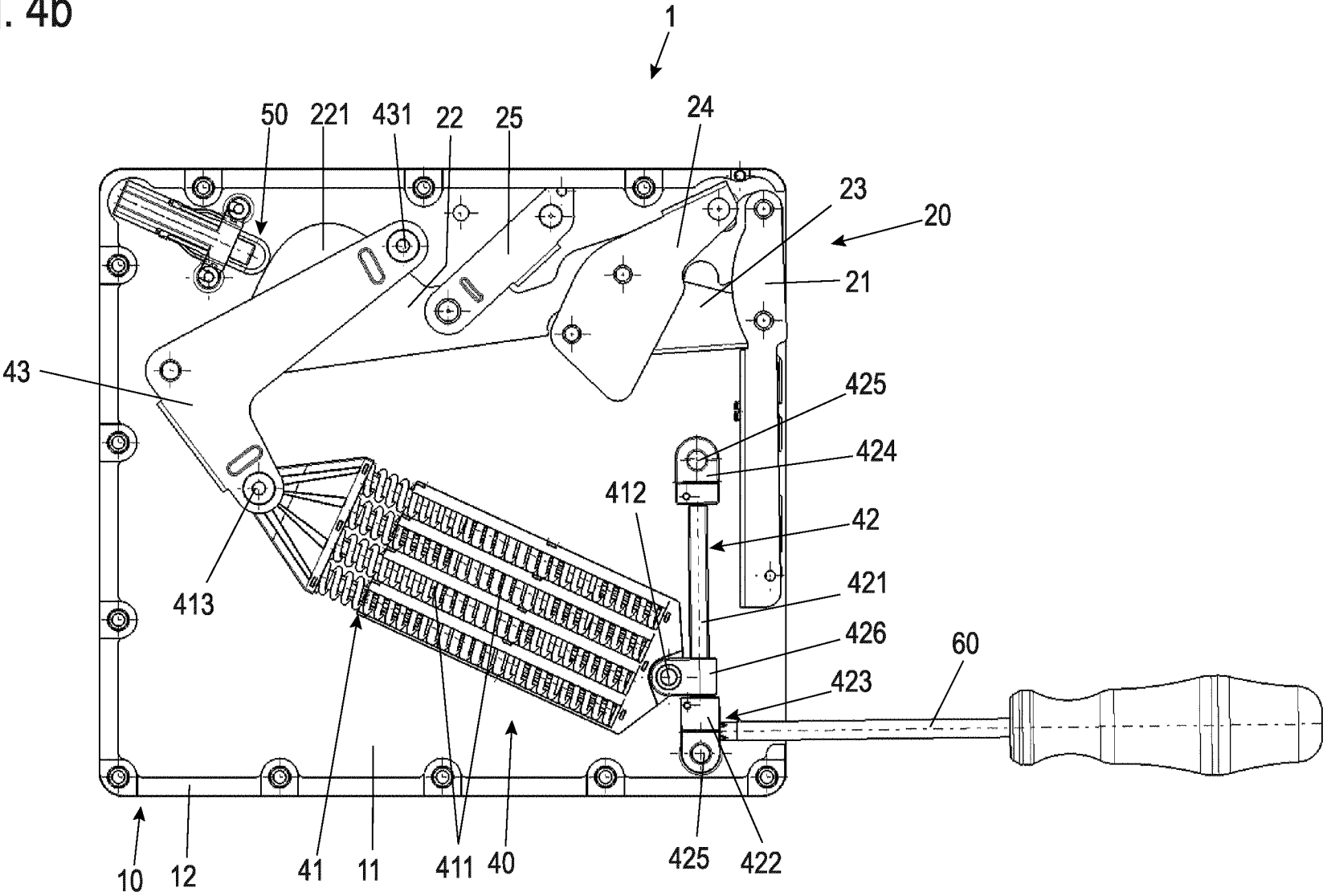
Figure 5A:
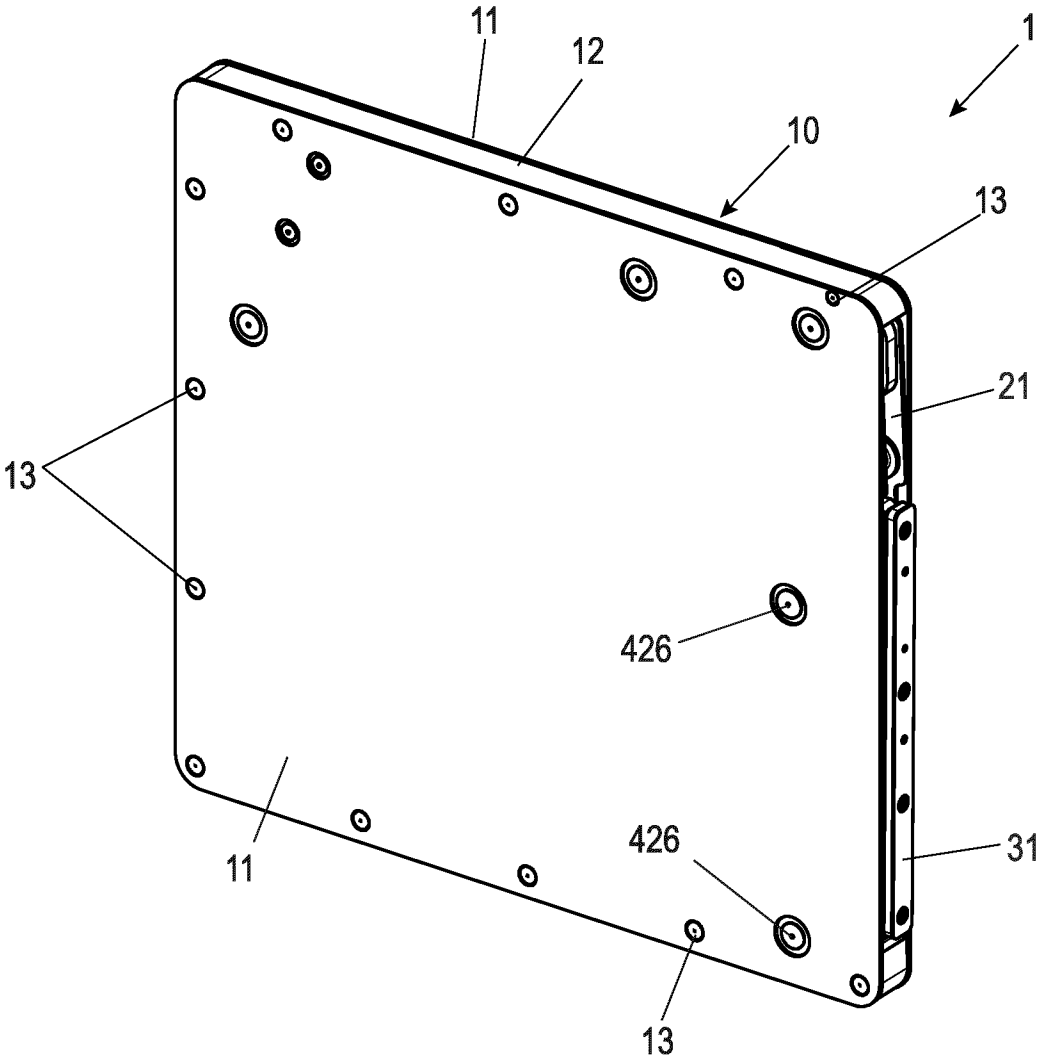
Figure 5B:
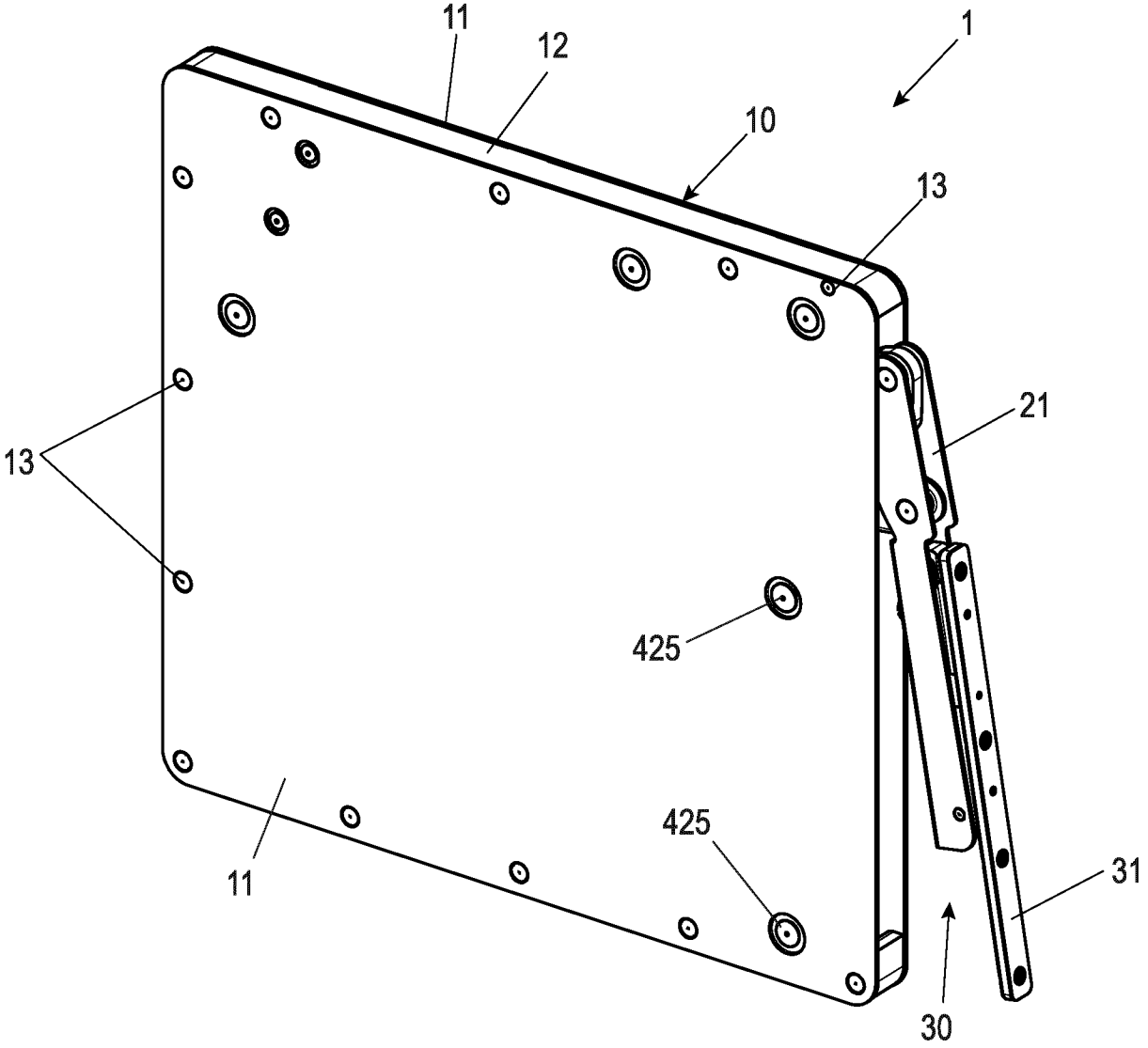
Figure 6:
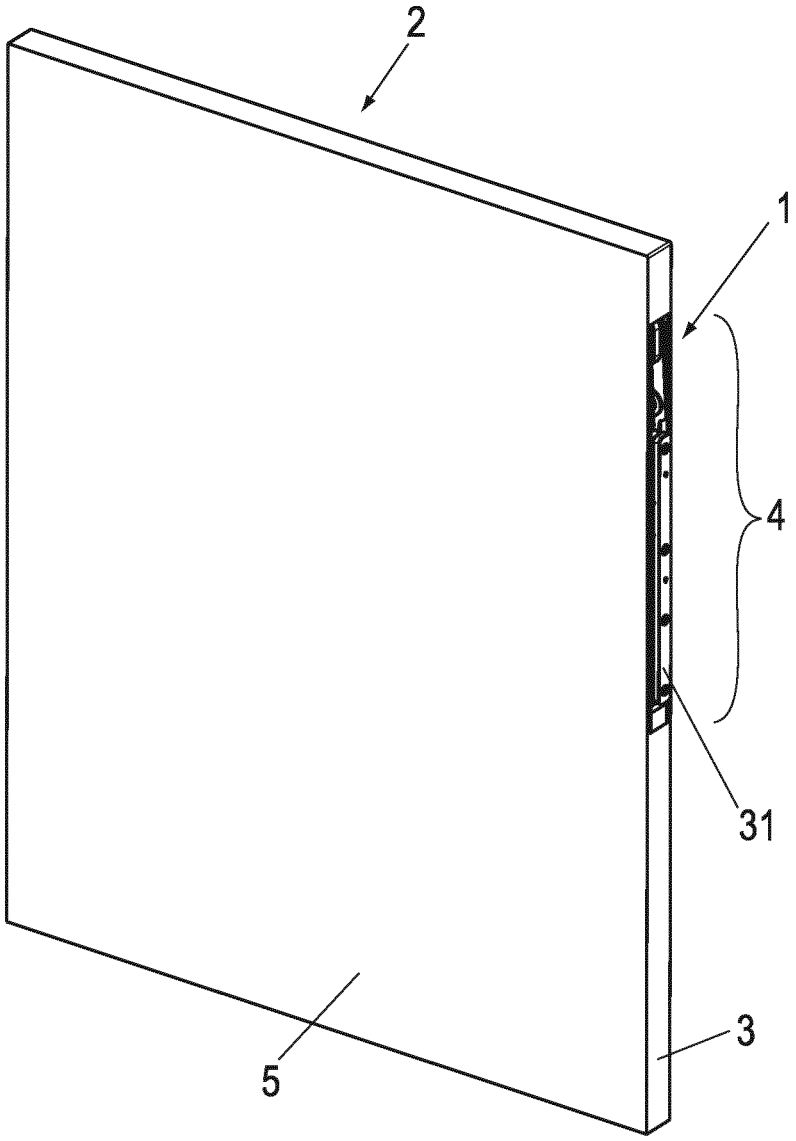
Figure 7A:
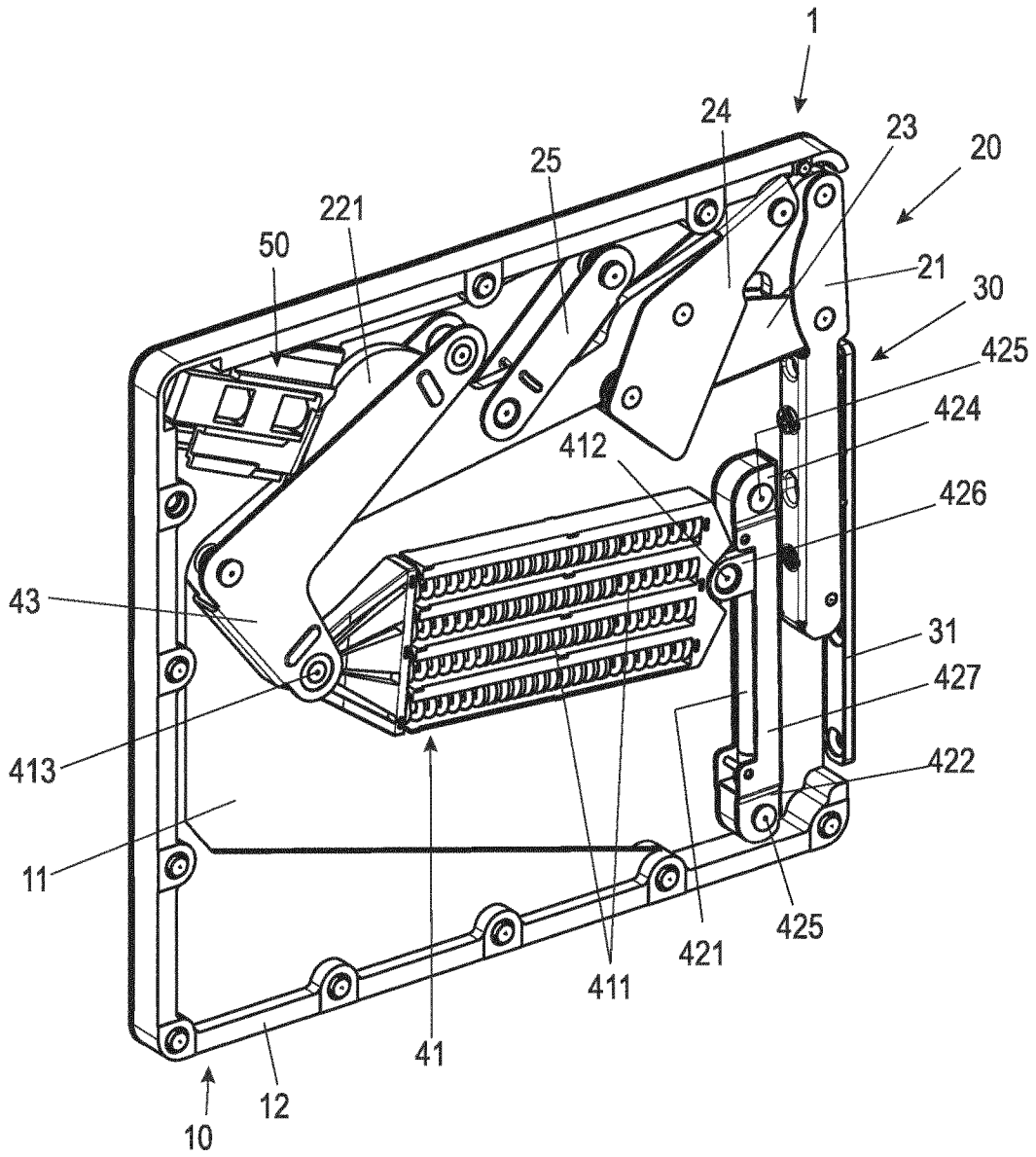
Figure 7B:
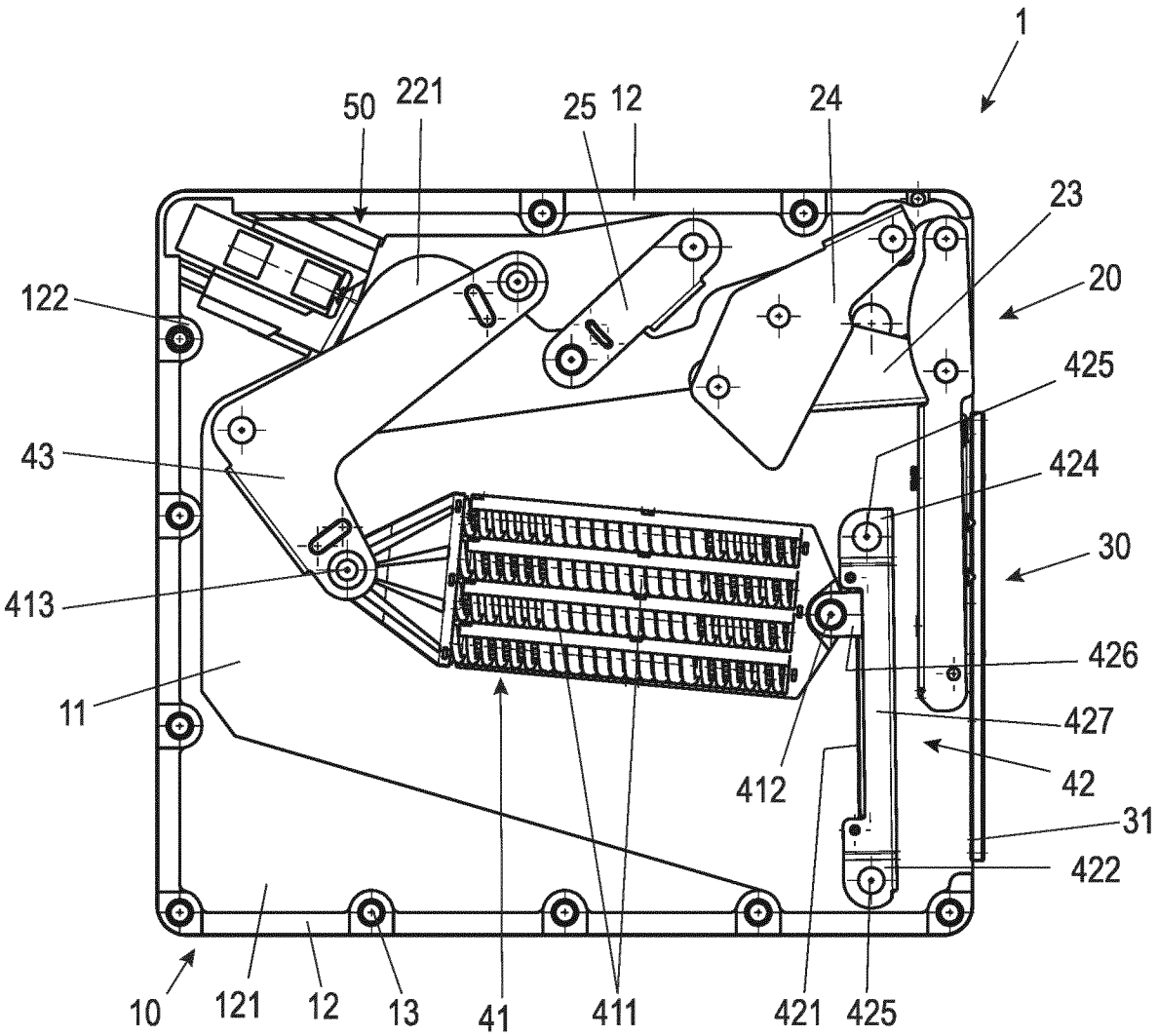
Figure 7C:
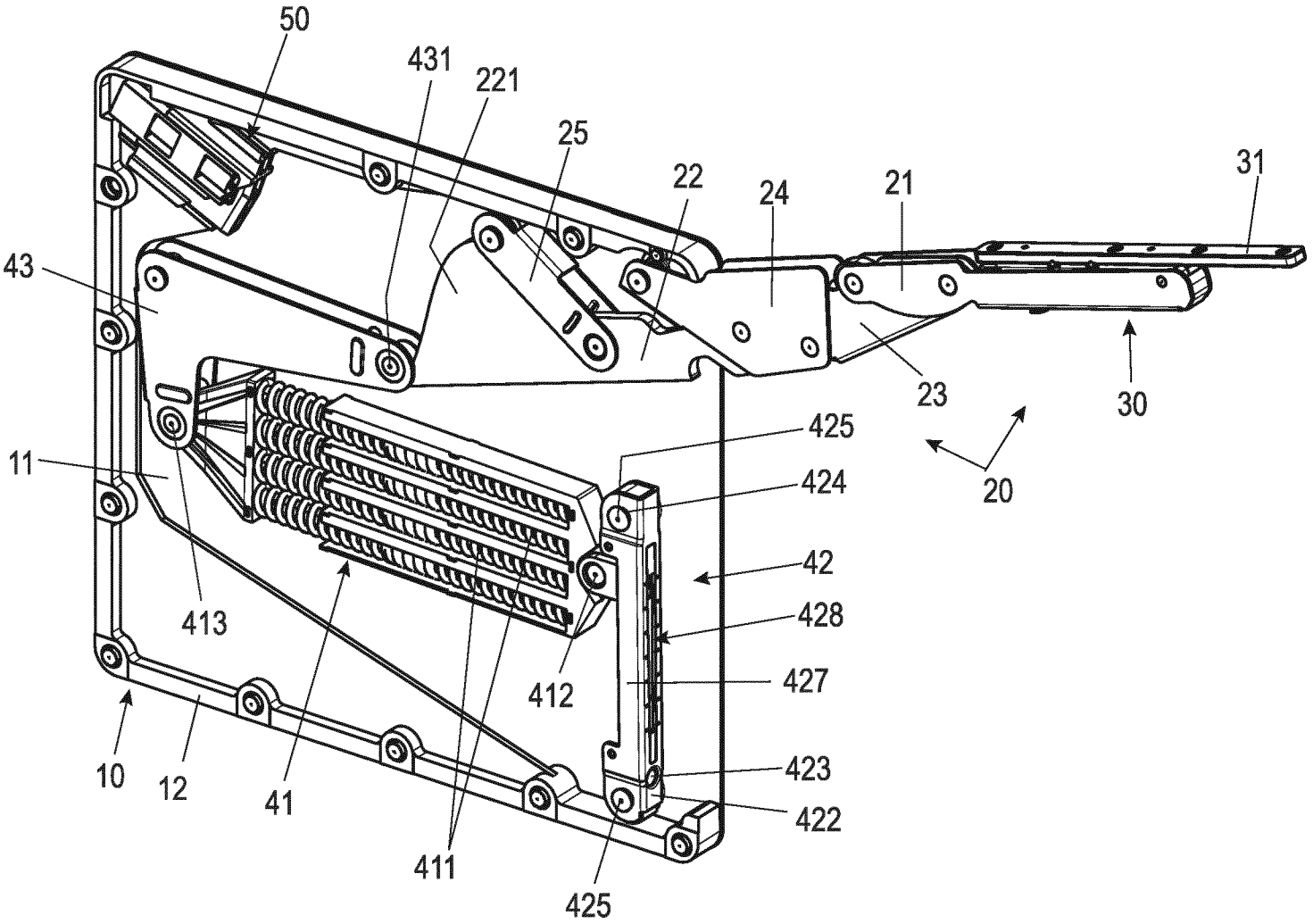
Figure 8:
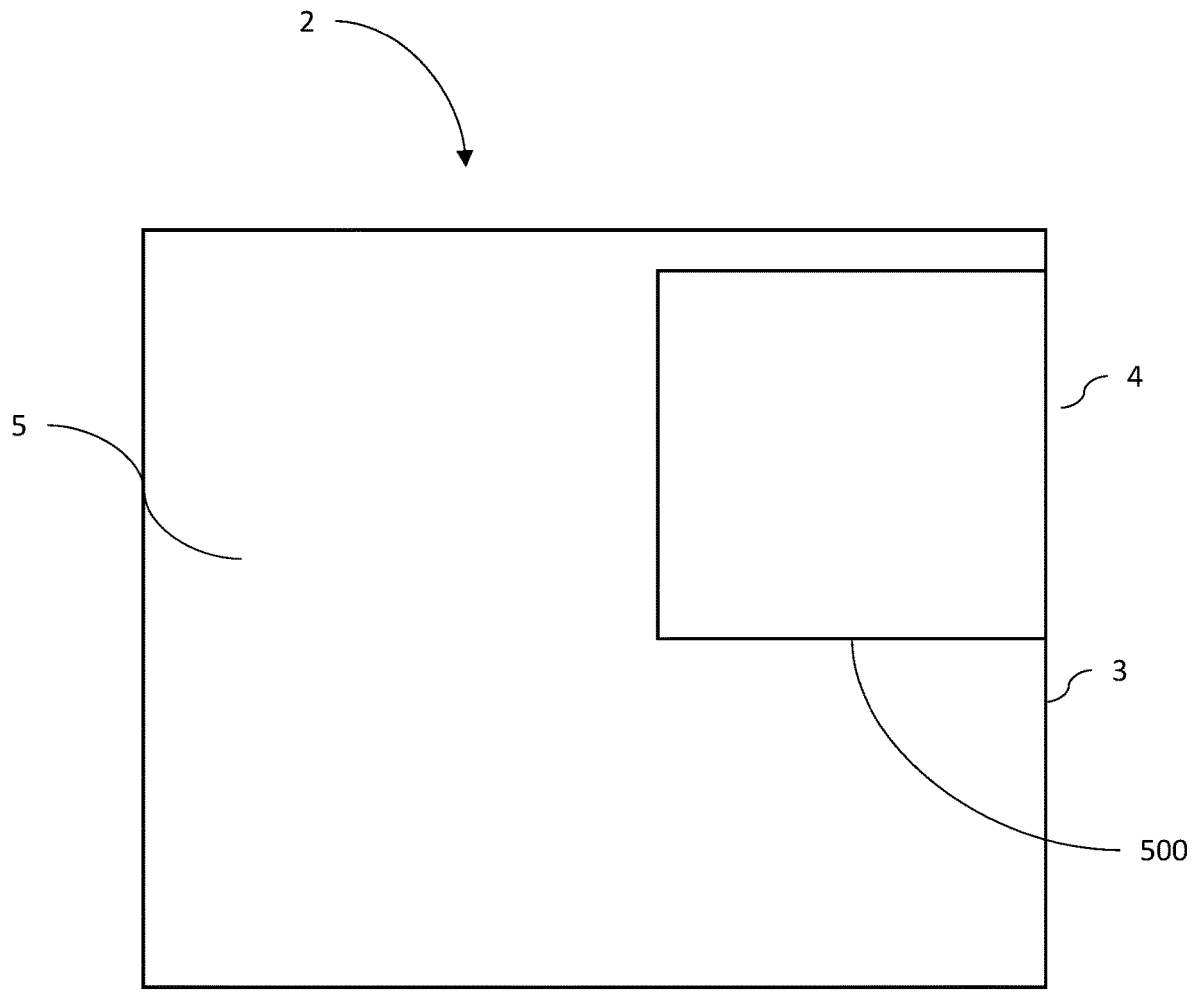

The invention will be explained in greater detail hereafter on the basis of exemplary embodiments with the aid of figures. In the figures:

FIGS. 1*a*, 1*b* show an isometric view and a side view of a flap fitting in a closed position having open housing;

FIGS. 2*a*, 2*b* show the flap fitting of FIGS. 1*a* and 1*b* in an isometric view or a side view in an open position;

FIGS. 3*a*, 3*b* show the flap fitting as in FIG. 2*b* having applied setting tool in two different spring settings;

FIGS. 4*a*, 4*b* show the flap fitting as in FIG. 1*b* having applied setting tool in two different spring settings;

FIGS. 5*a*, 5*b* show the flap fitting of the preceding figures having closed housing in a closed (FIG. 5*a*) and a partially-open (FIG. 5*b*) position;

FIG. 6 shows a furniture panel as a side wall of a furniture body having an integrated flap fitting in an isometric view;

FIGS. 7*a-c* show various illustrations of a flap fitting in an alternative embodiment for use in a furniture panel according to FIG. 6; and FIG. 8 is a highly schematic illustration of a furniture panel having a flap fitting laterally inserted through a pocket.

DETAILED DESCRIPTION

In FIGS. 1*a* and 1*b* and 2*a* and 2*b*, respectively, a first example of a flap fitting 1 is illustrated in a closed position (FIGS. 1*a*, 1*b*) and a completely open position (FIGS. 2*a*, 2*b*) of a flap (not shown here) guided by the flap fitting 1. FIGS. 1*a* and 2*a* show the flap fitting in an isometric illustration and FIGS. 1*b* and 2*b* show it in a side view.

In the description, terms such as upper, lower, left, right refer exclusively to the illustration selected by way of example in the respective figures. The terms front and rear generally refer to an opening movement of the guided flap. The front side is a side facing toward the user in this case.

A housing 10 of the flap fitting is shown open on one side in each case to be able to illustrate the internal structure of the flap fitting 1. In all figures, identical reference signs identify identical elements. For reasons of comprehensibility, in the figures, not every element is provided with a reference sign in all figures.

In the illustrated embodiment, the housing 10 is formed from two side panels 11, of which only the rear one is shown in the figures. The side panels 11 are spaced apart from one another and aligned parallel to one another by a partially circumferential frame 12. A plurality of rivets 13 (cf. FIGS. 3*a*, 3*b*), using which the housing 10 and thus the flap fitting 1 is held together, lead through the side panels 11 and the frame 12. Instead of the rivets, other fastening means, for example, screws, can also be used. The rivets 13 lead through widened portions 122 of the frame 12.

In the illustrated flap fitting 1, all further components are fastened on the side panels 11, for example, also using rivets or bolts, which lead through one or both of the side panels 11.

The flap fitting 1 comprises a lever mechanism 20 having five levers, which are connected in seven joint points to one another and/or to the housing 10. The flap fitting 1 is thus designed as a seven-joint hinge. The lever mechanism 20 comprises a door bearing lever 21 as the outermost element of the lever mechanism 20, which is connected via an adjustment device 30 to an installation plate 31. The flap to be guided by the flap fitting 1 is installed on this installation plate 31. The adjustment device 30, which is illustrated in greater detail in the following figures, enables an adjustment movement of the installation plate 31 and thus of the guided flap in relation to the door bearing lever 21.

The door bearing lever 21 is rotatably connected at the upper joint point in FIGS. 1*a*, 1*b* to a transmission lever 22. The door bearing lever 21 is connected to a deflection lever 23 in a lower joint point in the figures. The deflection lever 23 and the transmission lever 22 are in turn linked to a control lever 24. The transmission lever 22 is connected at its rear end to a support lever 25, wherein the support lever 25 is in turn rotatably mounted on the housing 10. This lever mechanism 20 thus results in a seven-joint chain.

As is apparent from FIGS. 2*a* and 2*b*, the individual levers of the lever mechanism 20 are shaped so that they form an approximately stretched arrangement in the open position of the flap. During the opening or closing procedure, the outer element of the lever mechanism 20, the door bearing lever 21, executes a combined rotational and translational movement, due to which an installed flap is not only pivoted, but rather also is moved forward so that it is guided with its upper edge over an upper or the uppermost body edge.

The flap fitting 1 furthermore comprises a spring unit 40, which holds the flap both in the closed and also in the completely open state by the application of spring force. In particular in the completely open state, the spring unit 40 is capable of compensating for the weight of the flap, so that it remains in the open position without further locking levers.

In the illustrated exemplary embodiment, the spring unit 40 comprises a spring packet 41 having a plurality of compression springs 411. In alternative embodiments, a spring unit can also comprise only one spring instead of a plurality of springs. A right side of the spring packet 41 in the figures is mounted in a fixed spring bearing 412. A left side of the spring packet 41 in the figures is mounted in a free spring bearing 413 at a shorter end of an angled intermediate lever 43, wherein the intermediate lever 43 is formed as a two-sided lever and is mounted so it is pivotable on the housing 10. A pressure roller 431, which acts on a control portion 221 of the transmission lever 22, is attached at the end of the second, free lever arm of the intermediate lever 43. The fixed spring bearing 412 secures the right side of the spring packet in the figures in relation to the housing 10. The position of this fixed spring bearing 412 is adjustable by a spindle unit 42, however, to be able to set a spring pre-tension and also an action direction of the spring packet 41 on the intermediate lever 43. The additions "fixed" and "free" in the case of the spring bearings 412, 413 refer to a position of the spring bearings 412, 413 during a movement of the lever mechanism 20. The fixed spring bearing 412 maintains its position, the free spring bearing 413 moves along the control portion 221 in accordance with the movement of the pressure roller 431. Details of the spindle unit 42 are explained further hereafter.

The control portion 221 extends in a dome shape on its edge having a rising (left side of the control portion 221 in the figures) and a falling flank (right side of the control portion 221 in the figures). When the pressure roller 431 presses against the falling flank, a pressure of the pressure roller 431 has the result of moving the lever mechanism 20 in the direction of the closed position. The installed flap is accordingly pressed closed or kept closed. The opening movement passes through a dead point when the pressure roller is just located on the dome of the control portion 221. In the further course of the opening movement, the pressure roller 431 presses against the rising flank of the control curve, wherein the pressure of the pressure roller 431 has the result of moving the lever mechanism 20 further in the direction of the open position. The opening movement is accordingly assisted and the flap is held in the open position.

The spindle unit 42 comprises a spindle 421, which is mounted so it is rotatable in a first spindle bearing 422 (lower here) and a second spindle bearing 424 (upper here). Moreover, an angular gear is arranged in the first spindle bearing 422, which transmits a rotational movement of an adjustment element having a tool receptacle 423 to the spindle 421, for example, via intermeshing bevel gears. The tool receptacle 423, for example, a slotted, a cross head, a hexagonal, or a polygonal receptacle, is oriented forward in the direction of the open region of the housing 10 and is accessible from there.

The two spindle bearings 422, 424 are fastened on the housing 10 using fastening means 425. The fastening means 425 are, for example, rivets, which are guided through both side panels 11 comparably to the rivets 13, so that the spindle unit 42 is arranged and fastened between the two side panels 11.

By rotating the spindle 421, a spindle nut 426 moves along the spindle 421, wherein the fixed spring bearing 412 is formed on the spindle nut 426. Accordingly, a rotational movement of the tool receptacle 423 and thus of the adjustment element displaces the fixed spring bearing 412 along the spindle 421 and thus changes the spring pre-tension and the engagement direction of the spring unit 41 on the intermediate lever 43.

It is to be noted that an adaptation of the spring action can be carried out not only by a change of the spring pre-tension, but rather alternatively and/or additionally also by a change of a transmission ratio, using which forces are transmitted from the spring unit to the lever mechanism.

Furthermore, a damping unit 50 is provided, in the present case a linear damper operating as a compression damper, against which a portion of the transmission lever 22 moves, specifically a part of the control portion 221 of the transmission lever 22 here, to decelerate the lever mechanism 20 as it approaches the closed state.

In principle, the damping unit 50 could also be arranged at another point inside the housing 10 and could act on another lever or arm of the lever mechanism 20 to decelerate an approach of the flap to one of the end positions (closed/open) and thus damp it. In a refinement, two independent damping units 50 can also be provided, of which one performs a closing damping and the other performs an opening damping.

The setting capability resulting due to the spindle unit 42 and a setting procedure of the spring unit 41 are shown in FIGS. 3*a, b* and 4*a, b*.

In FIG. 3*a*, the flap fitting 1 is illustrated in a completely open state of the door bearing 21 and/or a flap connected thereto, in the same manner as in FIG. 2*b*. A setting tool 60 in the form of a screwdriver is inserted into the tool receptacle 423 of the spindle unit 21. A shaft of the setting tool 60 leads through the opening of the housing 10, into which the lever mechanism 20 plunges during the closing of the flap. The flap fitting 1 can thus be set from the end face of the housing 10 when the flap is open.

FIG. 3*b* shows the flap fitting 1 with changed setting of the spring unit 40. In this position shown by way of example, the fixed spring bearing 412 has been moved from the uppermost setting (FIG. 3*a*) into the lowermost setting. The spindle unit 42 enables the setting of any arbitrary intermediate position. The slope of the spindle 421 and/or the friction of the spindle nut 426 on the spindle 421 are selected so that the spindle unit 42 is self-inhibiting. A set intermediate position is accordingly maintained.

The change of the setting of the spring unit 40 changes, on the one hand, the spring pre-tension of the compression springs 411 and, because of the different angle at which the spring packet 42 acts on the intermediate lever 43, also changes the dynamics of the force action of the spring packet 41 on the lever mechanism 20. The manner in which these dynamics change and also the type of the change of the spring pre-tension is dependent on the alignment of the spindle unit 42 inside the housing 10. An alignment of the spindle unit 42 parallel to a front edge of the housing 10 has proven to be particularly advantageous for the construction shown.

In FIGS. 4*a* and 4*b*, an adjustment of the spindle unit 42 in the closed position of the flap fitting 1 is shown in a similar manner as in FIGS. 3*a* and 3*b*. An adjustment with retracted lever mechanism 20 is possible if the flap fitting 1 is not connected to the attached flap and also the installation plate 31 is not arranged on the adjustment device 30 of the door bearing lever 21. If only the door bearing lever 21 of the lever mechanism 20 is retracted between the two side panels 11, a part of the opening of the housing 10 remains free in the lower region, through which the setting tool 60 can be guided. In this manner, even if the flap is not attached, the spindle unit 42 can be preset, for example, even before installation of the flap, to a setting to be expected, which only has to be slightly corrected thereafter.

An isometric view of the flap fitting of FIGS. 1*a* to 2*b* having closed housing 10, i.e., having attached second side panel 11, is shown in FIGS. 5*a* and 5*b*. FIG. 5*a* shows the flap fitting in a closed state of an installed flap (not visible here) and FIG. 5*b* shows a partially-open state, wherein the opening angle is approximately 10°.

The housing 10 is closed in the region of the frame 12 by the above-mentioned rivets 13. It is obvious that instead of the rivets 13, other connecting elements can be used for closing the housing 10, for example, screws. Alternatively, closing of the housing can also be performed by an adhesive bond between the side panels 11 and the frame 12.

FIG. 5*a* in particular shows that in the closed position of the flap fitting 1, the entire lever mechanism 20 including the adjustment device 30 retracts between the side panels 1.

FIG. 6 shows a furniture panel according to the application, which forms a side wall 2 of a furniture body (not shown in greater detail), in which a flap fitting 1 according to the application is integrated, for example, as shown in FIGS. 1*a* to 3*b*. A furniture body generally comprises at least two such side walls 2, wherein a corresponding flap fitting 1 according to the invention is integrated into both. The two—or possibly further flap fittings 1, which are integrated in intermediate walls of the furniture body—support a flap closing the furniture body to the front.

An opening 4, through which the lever mechanism 20 of the flap fitting 1 extends, is formed in a front end face 3 of the side wall 2. The flap fitting 1 is either inserted through the opening 4 into a pocket formed behind it in the side wall 2 or is already integrated into the side wall 2 during the production thereof or, as illustrated in FIG. 8, is inserted laterally through a pocket 500, which is introduced from a lateral face 5 and comprises an opening 4 on the end face 3. In all cases, the flap fitting 1 is integrated into the side wall 2, wherein at least in the first two cases, the flap fitting is covered on its sides by lateral faces 5 of the side wall 2 and is therefore not visible from the outside or from the inside of the furniture body. It is essential here that the flap fitting 1 and the side wall 2 form a unit, and the side wall 2 having inserted flap fitting has no or almost no thickness difference.

To be integrated into the furniture panel or side wall 2 of the furniture body, the thickness of the flap fitting 1, i.e., the outer spacing of the side panels 11, is strongly restricted by specifications with respect to the wall thickness of the furniture body. In the case of typical side walls of furniture bodies having a thickness of 16 mm (millimeters), the thickness of the flap fitting is necessarily less than 16 mm and is preferably less than or equal to 14 mm. Accordingly, the lever mechanism 20 including the adjustment device 30 is formed so that it can be retracted between the two side panels 11, which have this spacing.

Lateral faces of the furniture panel or the side wall 2 can thus comprise a continuous surface, which is not interrupted by any elements of the flap fitting 1. This is achieved in particular in that the tool receptacle 423 of the flap fitting 1 is reachable through the opening in the end face of the flap fitting and the furniture panel or the side wall 2.

FIGS. 7*a* to 7*c* show a second example of a flap fitting 1, which corresponds with respect to its basic structure and in particular its lever mechanism 20 to the flap fitting 1 of the first example. This flap fitting 1 can also be inserted or integrated into a furniture panel, from which a side wall of a furniture body is manufactured according to FIG. 6, for example.

In these figures, identical reference signs identify identical or identically-acting elements as in the preceding figures. Reference is explicitly made to the description of the first example. In particular the differences between the two examples are explained in greater detail hereafter.

In FIGS. 7*a* to 7*c*, the flap fitting 1 having open housing 10 is illustrated in two isometric illustrations (FIGS. 7*a*, 7*c*) and a side view (FIG. 7*b*). FIGS. 7*a* and 7*b* show the flap fitting in a closed position and FIG. 7*c* shows it in an open position of its lever mechanism 20.

A difference from the first example in the flap fitting 1 of the second example is in the design of the spindle unit 42. As in the first example, the spring packet 41 is mounted on one side so it is displaceable in position in the fixed spring bearing 412 via the spindle unit 42 on the housing 10 and acts on the intermediate lever 43 at its other end via the free spring bearing 413.

The spindle unit 42 differs in the second exemplary embodiment in that the spindle (only visible in FIG. 7*a*) is arranged in a U-shaped guide rail 427. The spindle nut 426 is guided in this U-shaped guide rail 427. Pressure forces acting from the spring packet 41 on the spindle unit 42 are absorbed in this design not only by the spindle 421, but rather in particular by the U-shaped guide rail 427. In addition, as shown in this example, a scale 428 can optionally be applied in the guide rail 427, wherein the position of the spindle nut 426 on the scale 428 is visible through a slot in the guide rail 427. In this manner, presetting of the spindle unit 42 to specific predetermined values can be performed. Moreover, the scale 428 facilitates identical setting of multiple flap fittings 1, which jointly guide a flap.

A further difference in the second example relates to the design of the frame 12, which comprises reinforcement ribs 121 in particular in the region of the rear portions of the flap fitting 1 opposite to the opening. Moreover, the damping unit 50 is integrated into the frame 12 in this example. The integral formation of the damping unit 50 in the frame 12 simplifies the installation of the flap fitting 1, since the damping unit 50 does not have to be separately connected to the housing 10.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 flap fitting
2 side wall
3 end face
4 opening
5 lateral face
10 housing
11 side panel
12 frame
121 reinforcing rib
122 widened portion
13 rivet
20 lever mechanism
21 door bearing lever
22 transmission lever
221 control portion
23 deflection lever
24 control lever
25 support lever
30 adjustment device
31 installation plate
40 spring unit
41 spring packet
411 compression spring
412 fixed spring bearing
413 free spring bearing
42 spindle unit
421 spindle
422 first spindle bearing
423 tool receptacle
424 second spindle bearing
425 fastening means
426 spindle nut
427 guide rail
428 scale
43 intermediate lever
431 pressure roller
50 damping unit
60 setting tool

The invention claimed is:

1. A furniture panel, comprising:

a front end face of the furniture panel including an end-face opening of the furniture panel; and an integrated or inserted flap fitting, the integrated or inserted flap fitting comprises a housing having an end-face opening of the flap fitting;

a lever mechanism having multiple levers configured to guide a flap of an item of furniture;

a spring unit having a first end coupled to and acting on at least one lever of the lever mechanism using settable pre-tension, wherein the lever mechanism retracts into the end-face opening of the flap fitting and in the end-face opening of the furniture panel in a closed position of the guided flap;

a spindle unit coupled to the second end of the spring unit, wherein the spindle unit includes a spindle and a first spindle bearing, wherein the first spindle bearing includes an adjustment element having a tool receptacle, wherein the settable pre-tension of the spring unit is settable via the adjustment element, and wherein the tool receptacle is accessible through an end-face opening of the furniture panel and/or the flap fitting, wherein the flap fitting is inserted through the end-face opening of the furniture panel into a pocket in the furniture panel formed behind the end-face opening of the furniture panel, or the flap fitting is integrated into the pocket during the production of the furniture panel, or the flap fitting is laterally inserted through a pocket, which is introduced from a lateral face of the furniture panel and comprises an opening on the front end face of the furniture panel.

2. The furniture panel of claim 1, wherein a spring bearing coupled to the second end of the spring unit is movable via the spindle.

3. The furniture panel of claim 2, wherein the spindle is coupled via an angular gear to the adjustment element.

4. The furniture panel of claim 2, wherein the spring bearing is configured to be guided so it is linearly displaceable in a guide rail arranged parallel to the spindle.

5. The furniture panel of claim 4, wherein the guide rail is U-shaped.

6. The furniture panel of claim 1, wherein the spring unit acts via a pressure roller on a control portion of one of the levers of the lever mechanism and holds the flap fitting in the closed or an open end position.

7. The furniture panel of claim 1, wherein the housing comprising two parallel sides spaced apart from one another.

8. The furniture panel of claim 7, wherein all joint axes of the lever mechanism are positioned between the sides in a closed state of the flap fitting.

9. The furniture panel of claim 8, wherein the sides have an internal spacing that is less than 14 mm.

10. The furniture panel of claim 7, wherein the sides of the flap fitting press against the end-face opening of the furniture panel.

11. The furniture panel of claim 7, wherein the spindle unit is fastened on at least one of the sides.

12. The furniture panel of claim 1, wherein there is no thickness difference in a region of the furniture panel including the flap fitting and a remaining region of the furniture panel.

13. The furniture panel of claim 1, wherein a scale, which is visible to a user, is arranged on the adjustment element.

14. The furniture panel of claim 1, wherein the spring unit acts via a pressure roller on a control portion of one of the levers of the lever mechanism and holds the flap fitting in the closed end position; and the spring unit acts via a pressure roller on a control portion of one of the levers of the lever mechanism and holds the flap fitting in the open end position.

15. A furniture body, comprising:

a furniture panel having a front end face of the furniture panel including an end-face opening of the furniture panel; and at least one flap fitting, which is inserted or integrated into a furniture panel, the at least one flap fitting comprising a housing having an end-face opening of the flap fitting;

a lever mechanism having multiple levers configured to guide a flap of an item of furniture; and a spring unit having a first end coupled to and acting on at least one lever of the lever mechanism using settable pre-tension, wherein the lever mechanism retracts into the end-face opening of the flap fitting and in the end-face opening of the furniture panel in a closed position of the guided flap;

a spindle unit coupled to the second end of the spring unit, wherein the spindle unit includes a spindle and a first spindle bearing, wherein the first spindle bearing includes an adjustment element having a tool receptacle, wherein the settable pre-tension of the spring unit is settable via the adjustment element, and wherein the tool receptacle is accessible through an end-face opening of the furniture panel and/or the flap fitting, wherein the flap fitting is inserted through the end-face opening of the furniture panel into a pocket in the furniture panel formed behind the end-face opening of the furniture panel, or the flap fitting is integrated into the pocket during the production of the furniture panel, or the flap fitting is laterally inserted through a pocket, which is introduced from a lateral face of the furniture panel and comprises an opening on the front end face of the furniture panel.

16. The furniture body of claim 15, wherein at least one side wall is formed by the furniture panel.

17. An item of furniture, comprising:

a furniture body including a furniture panel having a front end face of the furniture panel including an end-face opening of the furniture panel; and a guided flap, wherein the furniture panel includes an integrated or inserted flap fitting, wherein the integrated or inserted flap fitting comprises a housing having an end-face opening of the flap fitting;

a lever mechanism having multiple levers configured to guide a flap of an item of furniture; and a spring unit having a first end coupled to and acting on at least one lever of the lever mechanism using settable pre-tension, wherein the lever mechanism retracts into the end-face opening of the flap fitting and in the end-face opening of the furniture panel in a closed position of the guided flap;

a spindle unit coupled to the second end of the spring unit, wherein the spindle unit includes a spindle and a first spindle bearing, wherein the first spindle bearing includes an adjustment element having a tool receptacle, wherein the settable pre-tension of the spring unit is settable via the adjustment element, and wherein the tool receptacle is accessible through an end-face opening of the furniture panel and/or the flap fitting, wherein the flap fitting is inserted through the end-face opening of the furniture panel into a pocket in the furniture panel formed behind the end-face opening of the furniture panel, or the flap fitting is integrated into the pocket during the production of the furniture panel, or the flap fitting is laterally inserted through a pocket, which is introduced from a lateral face of the furniture panel and comprises an opening on the front end face of the furniture panel.

* * * * *